US007150117B2

(12) United States Patent
Venegas, Jr.

(10) Patent No.: US 7,150,117 B2
(45) Date of Patent: Dec. 19, 2006

(54) BACK-LIT STENCILED POST COVER

(76) Inventor: Frank Venegas, Jr., 5682 Lake Ridge Dr., Brighton, MI (US) 48116

( * ) Notice: Subject to any disclaimer, the term of this patent is extended or adjusted under 35 U.S.C. 154(b) by 66 days.

(21) Appl. No.: 11/066,675

(22) Filed: Feb. 25, 2005

(65) Prior Publication Data

US 2005/0231938 A1 Oct. 20, 2005

Related U.S. Application Data

(63) Continuation-in-part of application No. 09/829,033, filed on Apr. 9, 2001.

(51) Int. Cl.
*G09F 7/00* (2006.01)
*G09F 13/06* (2006.01)

(52) U.S. Cl. ..... 40/580; 40/612; 40/541; 40/540; 362/223

(58) Field of Classification Search ..... 40/579, 40/580, 541, 555, 558, 540, 554, 502, 612; 362/223, 225, 293
See application file for complete search history.

(56) References Cited

U.S. PATENT DOCUMENTS

| | | | | | |
|---|---|---|---|---|---|
| 1,445,483 | A | * | 2/1923 | Burke | 40/502 |
| 1,661,446 | A | * | 3/1928 | Rank et al. | 40/608 |
| 1,760,270 | A | * | 5/1930 | Griswold | 40/608 |
| 2,001,312 | A | * | 5/1935 | O'Connell | 431/126 |
| 2,156,553 | A | * | 5/1939 | Vendope | 40/558 |
| 3,080,149 | A | | 3/1963 | Pilboue | 256/57 |
| 3,181,849 | A | | 5/1965 | Mitchell | 267/1 |
| 3,416,484 | A | | 12/1968 | Chapman | 116/67 |
| 3,957,250 | A | | 5/1976 | Murphy | 256/19 |
| 4,019,301 | A | | 4/1977 | Fox | 52/725 |
| 4,164,084 | A | * | 8/1979 | Crockett | 40/660 |
| 4,329,801 | A | * | 5/1982 | Clausen | 40/607.03 |
| 4,438,484 | A | | 3/1984 | Winden | 362/267 |
| 4,454,671 | A | | 6/1984 | Morgenstern | 40/606.12 |
| 4,479,319 | A | | 10/1984 | Erlich | 40/595 |
| 4,643,955 | A | * | 2/1987 | Smith et al. | 429/34 |
| 4,817,316 | A | | 4/1989 | Walker | 40/576 |
| 4,819,135 | A | | 4/1989 | Padilla et al. | 340/432 |
| 4,924,362 | A | | 5/1990 | Janko et al. | 362/108 |
| 5,105,347 | A | | 4/1992 | Ruud et al. | 362/268 |
| 5,121,307 | A | | 6/1992 | Moore | 136/291 |
| 5,170,996 | A | | 12/1992 | Venegas, Jr. et al. | 256/69 |
| 5,323,583 | A | | 6/1994 | Venegas, Jr. | 52/727 |
| D349,164 | S | | 7/1994 | Fox | D25/38 |
| 5,500,642 | A | * | 3/1996 | Battle | 340/932.2 |
| D374,941 | S | | 10/1996 | Venegas, Jr. | D25/126 |

(Continued)

*Primary Examiner*—Cassandra Davis
(74) *Attorney, Agent, or Firm*—Gifford, Krass, Groh, Sprinkle, Anderson & Citkowski, PC

(57) ABSTRACT

A post assembly with illuminated information includes a hollow tube extending upwardly from a ground surface, the tube having a sidewall with textual or graphical information cut therethrough. A lighting assembly is disposed within the hollow tube, and a transparent or translucent sleeve positioned over the tube such that when the lighting assembly is activated, the textual or graphical information is visible through the transparent or translucent sleeve. The lighting assembly may include a flashing light. In the preferred embodiment the hollow tube is metal, and the transparent or translucent sleeve is constructed of plastic. The lighting assembly preferably comprises one or more fluorescent tubes. The textual or graphical information may be traffic-related, or it may concern other directives. The post preferably has a circular cross-section in the range of 2 to 10 inches, and an optional base may be provided for mounting to a ground surface.

7 Claims, 1 Drawing Sheet

U.S. PATENT DOCUMENTS

| | | | | |
|---|---|---|---|---|
| D380,274 | S | 6/1997 | Stamets | D25/38 |
| 5,890,794 | A | 4/1999 | Abtahi et al. | 362/183 |
| 5,956,875 | A | 9/1999 | Aughenbaugh | 40/607.03 |
| D426,898 | S | 6/2000 | Venegas, Jr. | D25/126 |
| 6,116,811 | A | 9/2000 | Goff | 404/6 |
| 6,158,881 | A | 12/2000 | Carne | 362/183 |
| 2002/0145878 | A1* | 10/2002 | Venegas, Jr. | 362/431 |

* cited by examiner

BACK-LIT STENCILED POST COVER

REFERENCE TO RELATED APPLICATION

This application is a continuation-in-part of U.S. patent application Ser. No. 09/829,033, filed Apr. 9, 2001, the entire content of which is incorporated herein by reference.

FIELD OF THE INVENTION

The present invention generally relates to protective covers for stanchions, and more particularly, to a protective cover with an integrated lighting assembly for the purpose of providing illuminated information.

BACKGROUND OF THE INVENTION

Stanchions are primarily used as protective barriers for guarding stationary structures against damage that would result from being struck by a vehicle. They are commonly found in industrial facilities, parking garages and lots, and around drive thru lanes at restaurants. Generally, stanchions consist of an outer sleeve of elongated tubular steel and a concrete core. In construction, one end and a portion of the elongated tubular steel body is supported perpendicularly in a fixed surface while the opposite end extends above the fixed surface at a distance approximately equal to the embedded portion. The interior cavity of the elongated tubular steel member is commonly filled with concrete as a reinforcing complement. While stanchions can adequately protect stationary structures against damage from vehicle accidents, it is not uncommon for people to receive minor injuries, or their vehicles to receive minor damage, when contact is made with a stanchion.

Protective covers, as described in U.S. Pat. No. 5,323,583, aid in reducing injury to people, and damage to cars, that make contact with unprotected stanchions. The smooth surface of protective covers minimizes the scratching or cutting that occurs when a grazing contact is made with an unprotected stanchion that typically has a rough surface. Additionally, by covering a stanchion with a resilient protective cover, repetitive maintenance that stems from long-term exposure is minimized and its esthetic appearance is enhanced.

For various applications, protective covers are made in several different sizes and colors. Such covers may also be customized to display a customer logo or advertisement. The lightweight structure and design of such covers allows for quick and easy installation. Once fitted to a stanchion, the protective cover enhances its esthetic features while providing a durable and smooth surface that reduces repetitive maintenance and injury that may occur from minor accidents. Colored covers have good visibility, but in dimly light to dark conditions the cover's visibility is substantially decreased.

Lighting bollards, such as the one described in U.S. Pat. No. 4,438,484, are low-level ground mounted lighting structures primarily in use in urban environments for lighting pedestrian walkways and building entrances at night. Lighting bollards typically feature a base, a steel housing fashioned with one or more windows, and a source of illumination. The source of illumination, and its supporting electrical components, are generally mounted within the interior of the housing and receives its power from an external source. Other types of low-level outdoor lighting elements are used in residential landscaping applications to provide illumination around patios, walkways, or plant beds.

These lighting elements commonly feature electrical conductors and a lamp receptacle disposed within an esthetic plastic housing. To provide power to these elements, they are generally connected to a track lighting type of network below the earth's surface.

While both these lighting structures are intended to provide illumination, neither is intended for use as a protective cover for a stanchion while providing light. A protective cover is useful for reducing repetitive maintenance and enhancing the esthetic character of stanchions, but a lighted protective cover would provide the additional feature of high visibility in a dark environment. Lighting bollards can provide the necessary light to maintain high visibility in poorly illuminated areas but they cannot provide the protective function of a stanchion.

SUMMARY OF THE INVENTION

This invention is directed to a post assembly with illuminated information. The preferred embodiment includes a hollow tube extending upwardly from a ground surface, the tube having a sidewall with textual or graphical information cut therethrough. A lighting assembly is disposed within the hollow tube, and a transparent or translucent sleeve positioned over the tube such that when the lighting assembly is activated, the textual or graphical information is visible through the transparent or translucent sleeve. The lighting assembly may include a flashing light.

In the preferred embodiment the hollow tube is metal, and the transparent or translucent sleeve is constructed of plastic. The lighting assembly preferably comprises one or more fluorescent tubes. The textual or graphical information may be traffic-related, or it may concern other directives. The post preferably has a circular cross-section in the range of 2 to 10 inches, and an optional base may be provided for mounting to a ground surface.

DETAILED DESCRIPTION OF THE INVENTION

Figure 1:
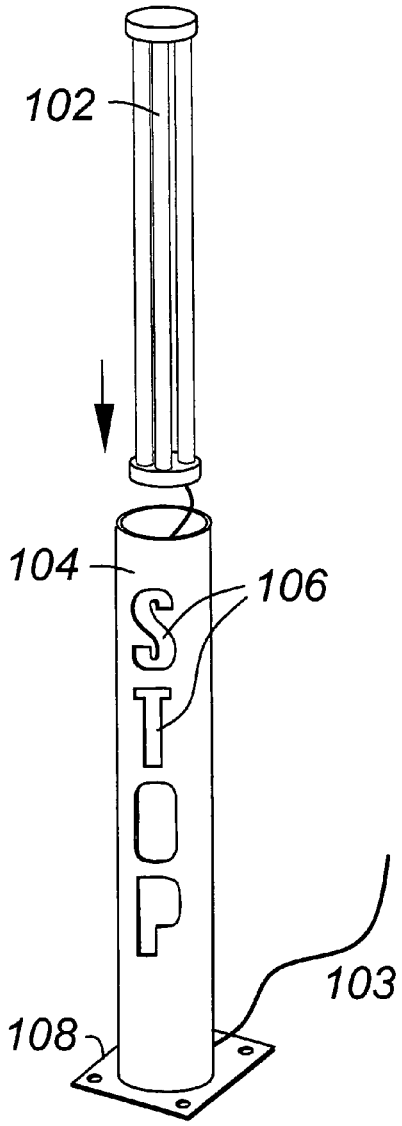
FIG. 1 is a drawing that shows the installation of a lighting assembly according to the invention.

This invention broadly provides an illuminated message through a transparent or translucent plastic sleeve, the message being formed through the wall of an inner post. Referring now to the drawings, FIG. 1 shows a lighting assembly 102 being installed into a post 104 having stencilized letters 106 formed therethrough. An electrical cord for the lighting assembly is shown at 103, and an optional base 108 with bolt holes may be provided.

In the preferred embodiment, the post 104 is constructed of steel, and the letters 106 are cut through the wall of the post using a cutting torch or other suitable approach such as laser cutting, water jets, and the like. The wall of the post 104 may be of any suitable thickness, generally in the range of one-eighth of an inch to three-eighths of an inch, though pipes having a one-quarter inch wall, more or less, are perhaps most typical.

Although the word "STOP" is shown for illustrative purposes, other messages may certainly be provided, including graphical images without letters, alphanumerical messages, and horizontal as well as vertical orientations. Examples of other suitable traffic-related messages may include SLOW, NO PARKING, HANDICAP ZONE, RAILROAD/CHILDREN CROSSING, TAXICAB STAND, BUS STOP, ENTRANCE, EXIT, FLOOR NUMBER, OFFICIAL/MILITARY/AUTHORIZED VEHICLES ONLY, RESTRICTED AREA, STREET NAME, ADDRESS, SPEED LIMIT, FIRE ZONE, ONE WAY, THIS WAY, NO EXIT, DEAD END, KEEP OUT, RESERVED PARKING, FOOD, BEER, and so forth.

In the preferred embodiment, the lighting assembly 102 comprises a plurality of fluorescent tubes, though, in alternative embodiments, other light sources may be used, including incandescent, neon, light-emitting diodes or other technologies.

Figure 2:
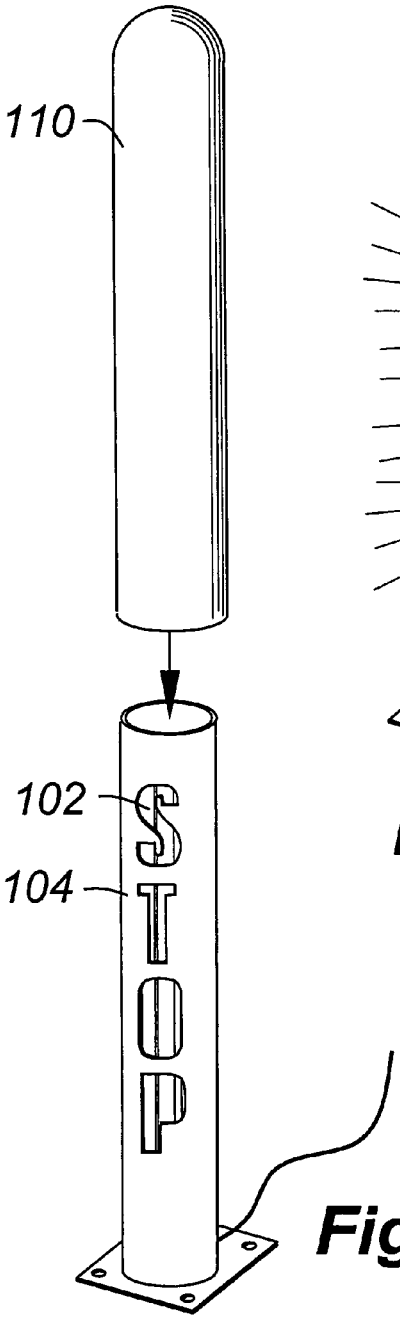
FIG. 2 is a drawing which shows the installation of a sleeve according to the invention.
Figure 3:
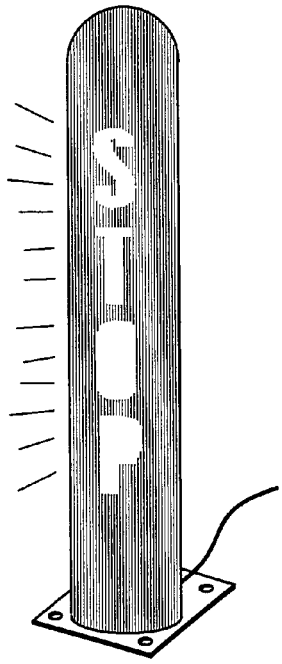
FIG. 3 illustrates a completed assembly with the illumination source activated.

FIG. 2 shows a sleeve 110 being installed over the post 104 including light assembly 102. Although a cylindrical sleeve with a hemispherical top is shown for illustrative purposes, any other type of sleeve design may be used, including sleeves having different geometrical cross sections, other ornamental features, and so forth. Although a substantially transparent sleeve may be used according to the invention, translucent sleeves are preferably used, including sleeves of different colors which may signify different message levels of urgency or other information.

I claim:

1. A post assembly with illuminated information, comprising:

a hollow rigid, metal tube extending upwardly from a ground surface, the tube having a sidewall with textual or graphical information cut therethrough;

an electrical lighting assembly disposed within the hollow tube; and a translucent colored plastic sleeve positioned over the tube such that when the lighting assembly is activated, the textual or graphical information is visible through the translucent sleeve.

2. The assembly of claim 1, wherein the lighting assembly comprises one or more fluorescent tubes.

3. The assembly of claim 1, wherein the textual or graphical information is traffic-related.

4. The assembly of claim 1, wherein the tube and sleeve have a circular cross-section.

5. The assembly of claim 1, wherein the tube and sleeve have a circular cross-section with a diameter in the range of 2 to 10 inches.

6. The assembly of claim 1, further including a base adapted for mounting to a ground surface.

7. The assembly or claim 1, wherein the lighting assembly includes a flashing light.

* * * * *